US005524651A

United States Patent [19]

Young et al.

[11] Patent Number: 5,524,651

[45] Date of Patent: Jun. 11, 1996

[54] INTERCHANGEABLE DECORATIVE ORNAMENT AND METHOD

[75] Inventors: Andrea G. Young, Wooster, Ohio; Tomima L. Edmark, Dallas, Tex.

[73] Assignee: The Topsytail Company, Dallas, Tex.

[21] Appl. No.: 336,404

[22] Filed: Nov. 8, 1994

Related U.S. Application Data

[63] Continuation-in-part of Ser. No. 16,519, Dec. 20, 1993, Pat. No. Des. 357,092.

[51] Int. Cl.[6] ..... A45D 8/24

[52] U.S. Cl. ..... 132/275; 132/279; 132/200; 2/151

[58] Field of Search ..... 132/200, 273, 132/275, 277, 278, 279; 160/348; 2/151, 154; D28/39-42

[56] References Cited

U.S. PATENT DOCUMENTS

| | | | |
|---|---|---|---|
| D. 26,504 | 1/1897 | Postert | D11/1 |
| D. 39,554 | 9/1908 | Farrell | D28/42 |
| D. 93,176 | 8/1934 | Murray | D11/75 |
| D. 121,818 | 8/1940 | Marrow | D11/143 X |
| D. 141,169 | 5/1945 | Petitta | D28/39 |
| D. 144,284 | 4/1946 | Behr | D28/42 |
| D. 178,226 | 7/1956 | Erenhouse | D28/39 |
| D. 343,508 | 1/1994 | Jones | D2/606 |
| D. 348,121 | 6/1994 | Park | D28/40 |
| 401,649 | 4/1889 | Hackett | 132/275 |
| 565,884 | 8/1896 | Emmons | 132/275 |
| 651,764 | 6/1900 | Mullinix | 132/275 |
| 672,816 | 4/1901 | Bassett | 132/275 |
| 717,499 | 12/1902 | Gouy | 132/275 X |
| 818,468 | 4/1906 | Regan | 132/275 |
| 926,450 | 6/1909 | Yeomans | 132/275 |
| 979,422 | 12/1910 | Burke | 132/280 X |
| 1,007,586 | 10/1911 | Martin | 132/275 |
| 1,039,910 | 10/1912 | Degenhardt | 132/275 X |
| 1,055,428 | 3/1913 | Stone | 132/275 X |
| 1,077,345 | 11/1913 | Hines et al. | 132/275 X |
| 1,091,936 | 3/1914 | Lange | 132/275 X |
| 1,221,172 | 4/1917 | Hamilton | 132/275 |
| 1,255,348 | 2/1918 | Stone | 132/275 |
| 1,316,981 | 9/1919 | Singer | 132/278 |
| 1,353,912 | 9/1920 | Kelley | 132/275 |
| 1,480,935 | 1/1924 | Gleason | 132/278 |
| 1,808,156 | 6/1931 | Burns | 132/275 |
| 1,863,878 | 6/1932 | Riley | 24/5 |
| 2,047,825 | 7/1936 | Johnson et al. | 24/6 |
| 2,272,514 | 2/1942 | Davis | 132/275 |
| 2,661,748 | 12/1953 | Racho | 132/275 |
| 4,991,607 | 2/1991 | Chen | 132/278 |
| 5,238,044 | 8/1993 | Gilley et al. | 160/348 |
| 5,318,054 | 6/1994 | Neilson et al. | 132/273 |
| 5,379,783 | 1/1995 | Healzer et al. | 132/275 |
| 5,398,705 | 3/1995 | Hiltbrand et al. | 132/275 |

FOREIGN PATENT DOCUMENTS

| | | | |
|---|---|---|---|
| 396429 | 1/1909 | France | 132/275 |
| 472857 | 12/1914 | France . | |
| 537622 | 3/1922 | France . | |
| 543333 | 6/1922 | France | 132/275 |
| 2748601 | 5/1979 | Germany | 132/277 |
| 200829 | 2/1924 | United Kingdom . | |

OTHER PUBLICATIONS

Newspaper article, John Taylor, "Women's Barrette Has a Twist", Jan. 15, 1994, Omaha, Nebraska, World Herald, Morning Edition.

*Primary Examiner*—John G. Weiss
*Attorney, Agent, or Firm*—Baker & Botts

[57] ABSTRACT

A decorative ornament (10) for displaying a decorative element (12) is provided. Decorative ornament (10) comprises a plurality of holding members (14) having openings (18) separated by spacing members (16). Holding members (14) are spaced apart to provide uninterrupted regions (20) between adjacent holding members (14). Decorative ornament (10) also comprises a coupling member (22) for coupling the decorative ornament (10) for display. Decorative element (12) is threaded through openings (18). Decorative element (12) is further drawn through uninterrupted regions (20).

4 Claims, 3 Drawing Sheets

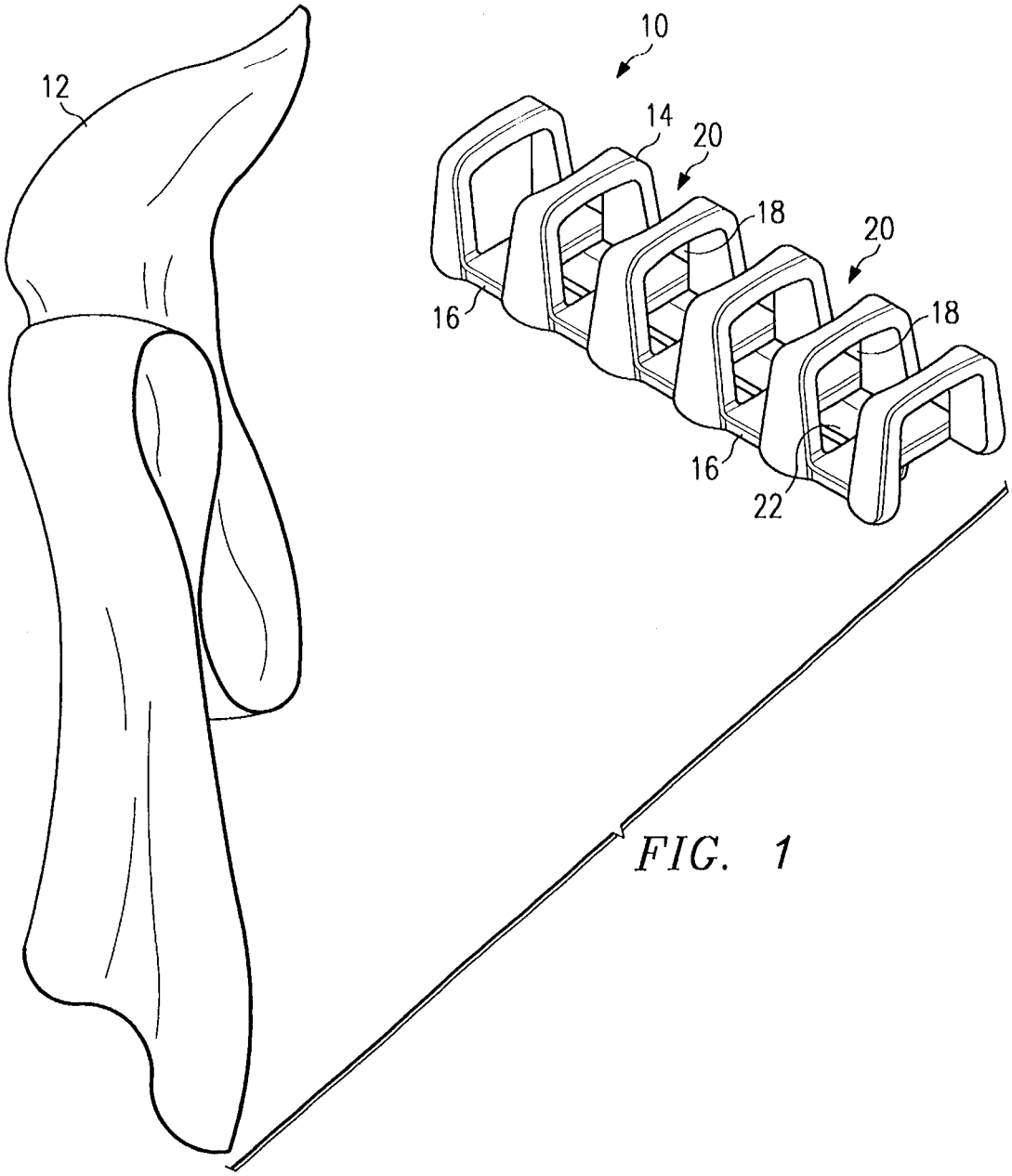
FIG. 1
FIG. 2
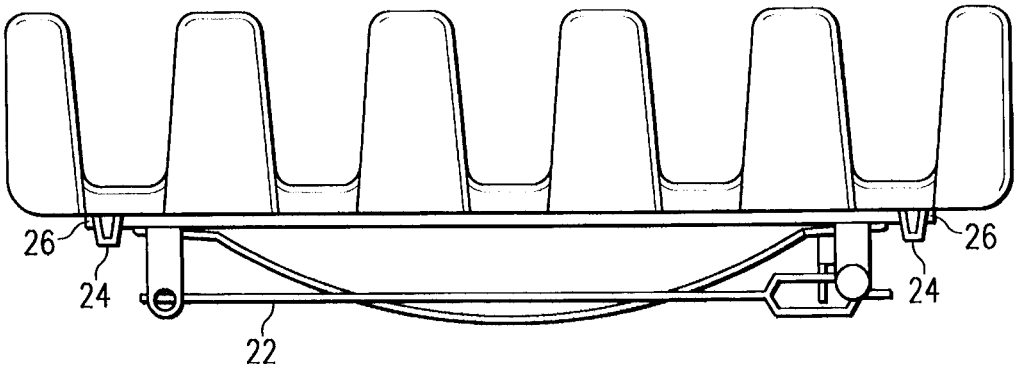

FIG. 3d
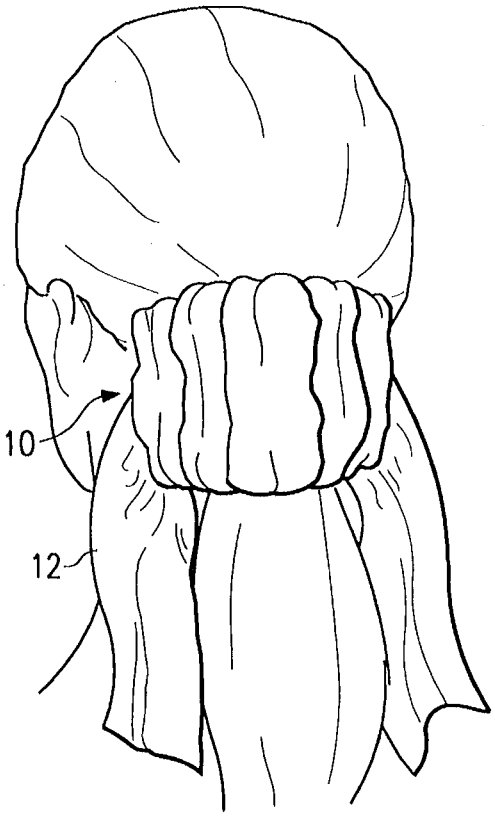
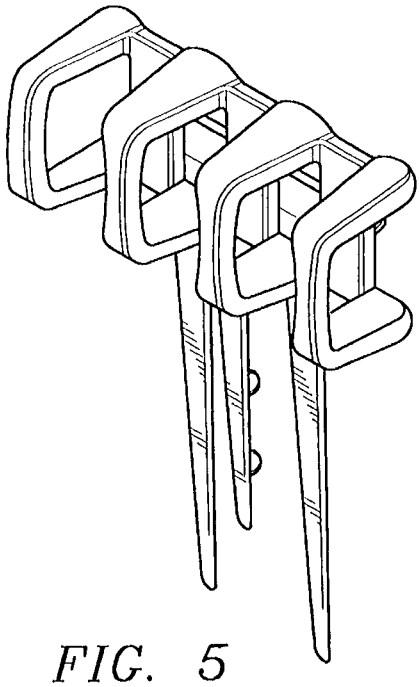
FIG. 5
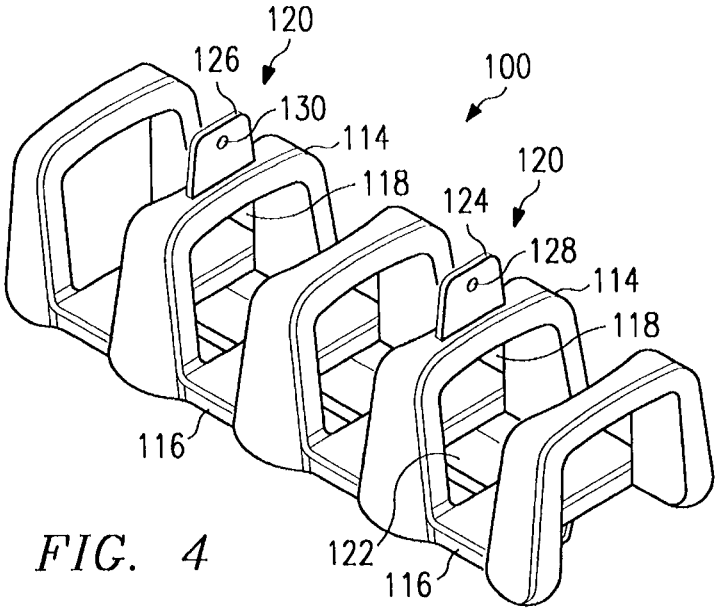
FIG. 4

INTERCHANGEABLE DECORATIVE ORNAMENT AND METHOD

CROSS REFERENCE TO RELATED APPLICATION

This application is a continuation-in-part of U.S. Design application Ser. No. 29/016,519, now U.S. Pat. No. Des. 357,092 filed Dec. 20, 1993, for a hair accessory.

TECHNICAL FIELD OF THE INVENTION

This invention relates in general to the field of decorative ornaments, and more particularly to an interchangeable decorative ornament.

BACKGROUND OF THE INVENTION

It is a common practice for people to use a scarf, ribbon or some other decorative material to ornament an outfit. Such decorative elements are made of various fabrics and are decorated with various prints, colors and patterns. Certain rules of fashion dictate that a particular decorative element will not go with every outfit. Some colors, styles and fabrics just do not look acceptable together.

A common problem encountered in using a scarf or ribbon to ornament an outfit is that they are not easy to use. It is difficult to learn how to fold and attach a scarf to an outfit in an appropriate manner to provide an attractive appearance. Several video tapes and brochures have been developed in an attempt to teach people various techniques to use a scarf to ornament an outfit. These techniques are not easy and if not done properly, may not result in an attractive appearance. Additionally, a scarf or ribbon may not stay fixed in place once attached.

There are several other problems with using a scarf, ribbon or other decorative fabric to ornament an outfit or hair. For example, such a decorative element may be tied in a user's hair to form, for example, a decorative bow. Unfortunately, a decorative element may easily loosen and fall out of the user's hair. Additionally, decorative elements are available in various shapes and sizes. Not all such decorative elements operate the same.

A typical hair bow incorporates some type of decorative fabric element. The decorative fabric element may be attached to the bow by glue, string, thread or the like such that the decorative fabric element may be destroyed if it is removed from the bow. Additionally, the decorative fabric element may be a scarf that is cut to a particular shape to create a desired look. Because the decorative fabric element may be cut, sewn, glued etc., it may not be removed and used in a different application without destroying the fabric element.

SUMMARY OF THE INVENTION

In accordance with the present invention, an interchangeable decorative ornament is provided which substantially eliminates or reduces disadvantages and problems associated with prior ornaments and methods.

In one embodiment, the present invention provides a plurality of holding members coupled together by, for example, a plurality of spacers. Each of the holding members includes an opening for receiving the decorative element. The holding members are spaced apart by a predetermined distance to form uninterrupted regions between adjacent holding members. The holding members are operable to display a decorative ornament comprising a decorative element such as a ribbon, piece of decorative fabric, or scarf. The decorative ornament also comprises a member for affixing the decorative ornament for display.

The decorative element may be applied to the holding members in any number of ways. For example, the decorative element may be threaded through the openings in the holding members. Subsequently, the decorative element may be drawn through the uninterrupted regions between the holding members. In this manner, the decorative ornament of the present invention provides an attractive manner for displaying the decorative element. Alternatively, the decorative element may be tied to, or wrapped around the holding members.

According to another aspect of the present invention, the interchangeable decorative ornament may include first and second tab members extending from associated holding members. The tab members include a hole for receiving a pin of a broach or some other decorative pin. The width of the tabs may be chosen such that movement of the decorative pin is minimized when attached to the tab members.

A technical advantage of the present invention is that it provides an easy to use method for displaying a decorative element such as a scarf. The scarf may be threaded through the openings of the holding members. Subsequently, the scarf may be drawn through the uninterrupted regions between adjacent holding members to provide a decorative display of the scarf.

Another technical advantage of the present invention is that it provides an attractive way to embellish an outfit using a decorative element such as a scarf. A decorative ornament constructed according to the teachings of the present invention may be used as a hair bow. Alternatively, such a decorative ornament may be used to hold a gathered portion of a shirt. Furthermore, such a decorative ornament may be displayed on a lapel or other appropriate portion of an outfit.

Another technical advantage of the present invention is that it provides an interchangeable decorative ornament. The appearance of the interchangeable decorative ornament may be quickly and easily changed by removing the decorative element and inserting a replacement decorative element. In this manner, a single decorative ornament may be used to embellish many different outfits. Furthermore, the decorative ornament, as displayed, does not appear to be interchangeable.

Another technical advantage of the present invention is that it allows non-destructive use of a decorative fabric element. The decorative fabric element may be displayed in a device constructed according to the teachings of the present invention without the necessity for cutting, sewing, gluing, or the like. Therefore, the decorative fabric element may be easily removed from the device and reused at a later time.

Another technical advantage of the present invention is that it works with a wide variety of decorative fabric elements. For example, scarves of various shapes and sizes may be easily substituted and displayed in a decorative ornament constructed according to the teachings of the present invention.

Another technical advantage of the present invention is that a single decorative fabric element may be stylized in a number of different configurations. For example, the decorative element may be threaded through the holding elements and puffed-out through the uninterrupted regions. Alternatively, the decorative element may be tied to the holding members. Furthermore, multiple decorative elements may be displayed at one time. Furthermore, the decorative element displayed in the decorative ornament may be coupled with another scarf worn by a user.

Another technical advantage of the present invention is that the decorative element may be further embellished by use of a pin or broach. The pin or broach may be held in place on the holding members by use of tab two or more tab members extending from the holding members.

BRIEF DESCRIPTION OF THE DRAWINGS

For a more complete understanding of the present invention and the advantages thereof, reference is now made to the following description taken in conjunction with the accompanying drawings in which like reference numbers indicate like features and wherein:

FIG. 1 is an exploded perspective view of one embodiment of a decorative ornament constructed according to the teachings of the present invention;

FIG. 2 is a side view of the decorative ornament of FIG. 1;

FIGS. 3*a*–3*d* illustrate a method for using the decorative ornament of FIG. 1 according to the teachings of the present invention;

FIG. 4 is a perspective view of another embodiment of a decorative ornament constructed according to the teachings of the present invention; and FIG. 5 is a perspective view of another embodiment of a decorative ornament constructed according to the teachings of the present invention,

DETAILED DESCRIPTION OF THE INVENTION

Figures 3A, 3B, 3C:
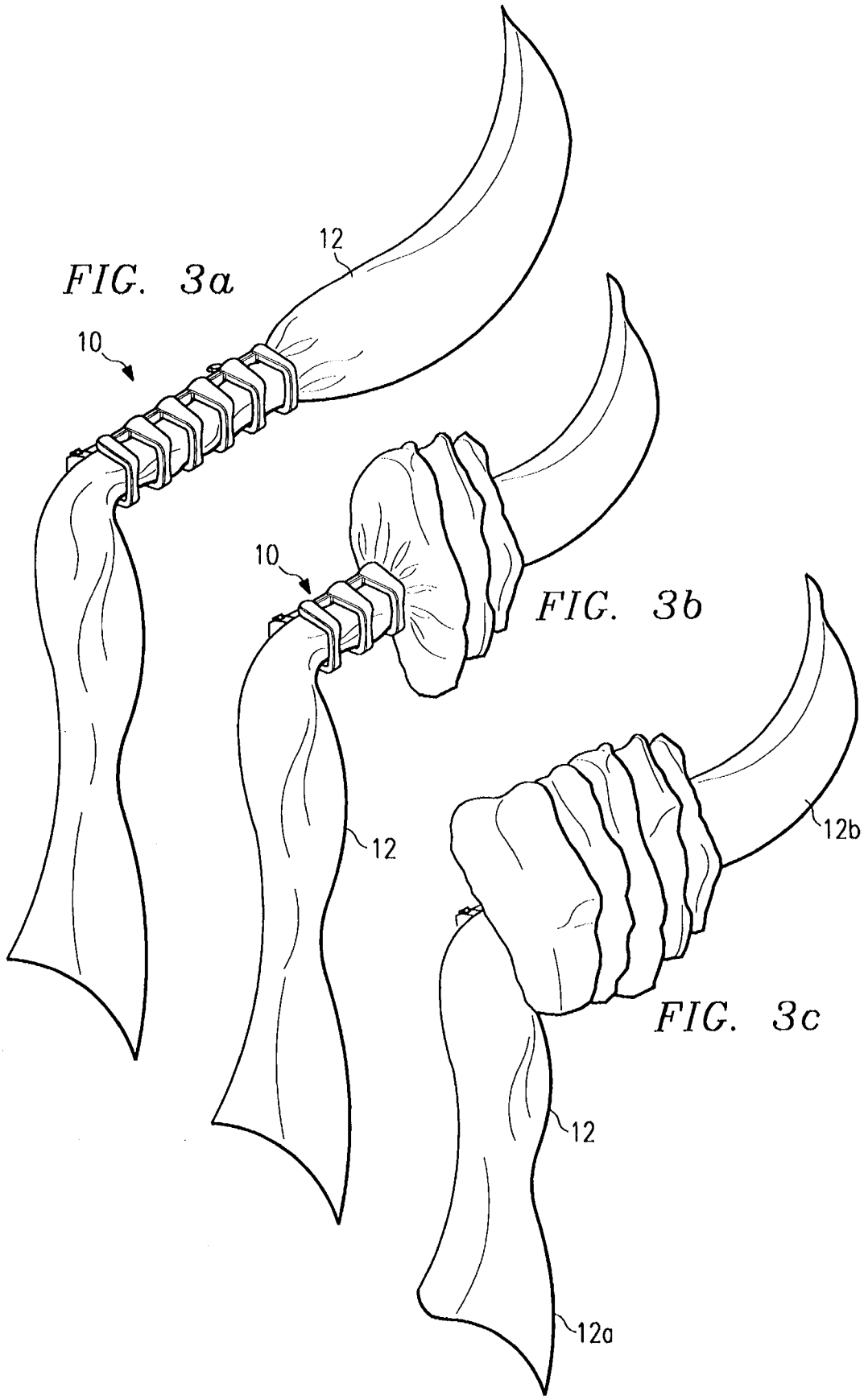

FIG. 1 illustrates one embodiment of a decorative ornament indicated generally at 10 and constructed according to the teachings of the present invention. Decorative ornament 10 may be used to display a decorative element 12. By way of example, and not by way of limitation, decorative element 12 may comprise, for example, a scarf, a ribbon, or any other appropriate decorative fabric for ornamenting an outfit. Furthermore, decorative element 12 may comprise any appropriate shape for use with decorative ornament 10 such as, for example, a square, a rectangle, an oval or any other appropriate shape. Additionally, decorative element 12 may comprise a fabric element commonly referred to as a "scrungie." Furthermore, decorative element 12 may comprise a plurality of individual decorative fabric elements.

Decorative ornament 10 is interchangeable. Decorative element 12 may be removed from decorative ornament 10 and replaced with another decorative element 12. Therefore, decorative ornament 10 may be used with various scarves or other decorative elements to match or work with various outfits or hairstyles.

Decorative ornament 10 comprises a plurality of holding members 14 for holding decorative element 12 in decorative ornament 10. Holding members 14 may, for example, be coupled together by a plurality of spacing members 16. Alternatively, holding members 14 may be coupled to a single spacing member 16 extending along the length of decorative ornament 10. Each holding member 14 forms an opening 18 for receiving decorative element 12 as described with respect to FIGS. 3*a* through 3*d* below. Holding members 14 are spaced apart by an appropriate distance to form uninterrupted regions 20 between adjacent, holding members 14 opposite spacers 16. The distance between holding members 14 may be chosen to allow decorative element 12 to be drawn between adjacent holding members 14. It is noted that the distance separating holding members 14 may be varied along the length of decorative ornament 10. Furthermore, the orientation of holding members 14 may similarly be varied. For example, holding members 14 may be coupled by spacers 16 to form an arc or a half circle. Holding members 14 may comprise, for example, substantially u-shaped members as shown in FIG. 1. Alternatively, holding members 14 may comprise any other appropriate shape. Furthermore, holding members 14 may comprise, for example, a flexible material such as a pliable metal or plastic. Alteratively, holding members 14 may be rigid.

Decorative ornament 10 may also comprise a coupling member 22. Coupling member 22 may be used to attach decorative ornament 10 for display. For example, coupling member 22 may comprise a barrette as shown in FIGS. 1 and 2 for coupling decorative ornament 10 to a user's hair. Alternatively, coupling member 22 may comprise any other appropriate coupler to attach decorative ornament 10 to a user's hair or outfit.

Coupling member 22 may be removably coupled to decorative ornament 10 by receiving members 24. Receiving members 24 may be coupled to a surface 26 of spacers 16 located at opposite ends of decorative ornament 10. Alternatively, coupling member 22 may be coupled directly to spacers 16.

In operation, decorative ornament 10 may be used as shown in FIGS. 3*a* through 3*d*. As shown in FIG. 3*a*, decorative element 12 may be threaded through openings 18 of holding members 14. Decorative element 12 may be folded before being passed through openings 18. Decorative element 12 may, for example, be pulled through openings 18 of decorative ornament 10 such that decorative element 12 is centered on decorative ornament 10. As shown in FIG. 3*b*, decorative element 12 may be drawn through uninterrupted regions 20 of holding members 14 to provide a puffed-out decorative appearance. In this manner, decorative element 12 may block holding members 14, spacers 16 and coupling member 22 from view. Decorative element 12 may be drawn through uninterrupted regions 20 beginning at approximately the center of decorative ornament 10. Subsequently, decorative element 12 may be drawn through uninterrupted regions 20 progressively closer to each end of decorative ornament 10. Alternatively, decorative element 12 may not be centered in decorative ornament 10. Rather, decorative element 12 may be pulled through openings 18 so that an appropriate length of decorative element 12 extends beyond one end of decorative ornament 10. Subsequently, decorative element 12 may be drawn through uninterrupted regions 20 beginning at the end of decorative ornament 10 with the appropriate length of decorative element 12 extending therefrom. FIG. 3*c* illustrates decorative ornament 10 with decorative element 12 ready for display. It is noted that portions 12*a* and 12*b* of decorative element 12 may be hidden from view by being tucked into appropriate holding members 14. Alternatively, portions 12*a* and 12*b* may be used to attach to a scarf or other portion of a user's outfit. Decorative ornament 10 may be coupled to, for example, a user's hair by coupling member 22 as shown in FIG. 2*d*. Alternatively, decorative ornament 10 may be appropriately coupled to a user's outfit.

FIG. 4 illustrates another embodiment of a decorative ornament indicated generally at 100 and constructed according to the teachings of the present invention. As with decorative ornament 10 of FIG. 1, decorative ornament 100 may be used with a decorative element (not shown) as described in conjunction with FIGS. 3*a* through 3*d*. Decorative ornament 100 comprises a plurality of holding members 114 which may, for example, be coupled together by a plurality of spacing members 116. Alternatively, holding members 114 may be coupled to a single spacing member 116 extending along the length of decorative ornament 100. Each holding member 114 forms an opening 118 for receiving a decorative element (not shown) as described above with respect to FIGS. 3*a*through 3*d*. Holding members 114 are spaced apart by an appropriate distance to form uninterrupted region 120 between adjacent holding members 114 opposite spacers 116. The distance between holding members 114 may be chosen to allow a decorative element to be drawn between adjacent holding members 114. The shape and spacing of holding members 114 may be varied as described above with respect to holding members 14 of FIG. 1. Decorative ornament 110 comprises a coupling member 122 similar to coupling 22 of FIG. 2.

Decorative ornament 100 further comprises first and second tabs 124 and 126 extending from selected holding members 114. Holes 128 and 130 are formed in tabs 124 and 126, respectively. Tabs 124 and 126 are operable to receive and hold a broach or other appropriate decorative pin on decorative ornament 100 once a decorative element is in place. Holes 128 and 130 are operable to receive and hold a pin of the broach (not shown). The width of tabs 124 and 126 and the placement of holes 128 and 130 may be chosen so as to limit the ability of a broach from moving once attached to decorative ornament 10.

FIG. 5 illustrates another embodiment of a decorative ornament indicated generally at 200 and constructed according to the teachings of the present invention. As with decorative ornament 10 of FIG. 1, decorative ornament 200 may be used with a decorative element (not shown) as described in conjunction with FIGS. 3*a* through 3*d*. Decorative ornament 200 comprises a plurality of holding members 214 which may, for example, be coupled together by a plurality of spacing members 216. Alternatively, holding members 214 may be coupled to a single spacing member 216 extending along the length of decorative ornament 200. Each holding member 214 forms an opening 218 for receiving a decorative element (not shown) as described above with respect to FIGS. 3*a* through 3*d*. Holding members 214 are spaced apart by an appropriate distance to form uninterrupted region 220 between adjacent holding members 214 opposite spacers 216. The distance between holding members 214 may be chosen to allow a decorative element to be drawn between adjacent holding members 214. The shape and spacing of holding members 214 may be varied as described above with respect to holding members 14 of FIG. 1. Decorative ornament 210 comprises a pin 222. Pin 222 may comprise a pin as shown and described in U.S. Pat. No. 5,251,650.

Although the present invention has been described in detail, it should be understood that various changes, substitutions and alterations can be made hereto without departing from the spirit and scope of the invention as defined by the appended claims. For example, the type of coupling member 22 may be varied without departing from the scope and teaching of the present invention. The shape of holding members 14 may also be altered to be square, Semicircles, half-moons, or any other appropriate shape.

What is claimed is:

1. A method for displaying at least one decorative fabric element, comprising the steps of:

threading a decorative fabric element through at least one opening of a plurality of holding members of a decorative ornament;

drawing the decorative element between uninterrupted regions between the holding members; and attaching the decorative element to a user using a coupling member, the holding members coupled to a portion of the coupling member.

2. The method of claim 1, wherein said step of threading a decorative fabric element comprises the step of tieing a plurality of decorative fabric elements to the holding elements.

3. The method of claim 1, wherein said step of threading a decorative fabric element comprises the step of threading a scarf through at least one opening of a plurality of holding members.

4. The method of claim 1, and further comprising the step of applying a decorative pin to the holding members by inserting the pin into holes in tabs on the holding members.

* * * * *